United States Patent [19]

Patton et al.

[11] 4,409,566

[45] Oct. 11, 1983

[54] COAXIAL LINE TO WAVEGUIDE COUPLER

[75] Inventors: Willard T. Patton, Moorestown; Robert J. Mason, Medford, both of N.J.

[73] Assignee: RCA Corporation, New York, N.Y.

[21] Appl. No.: 313,453

[22] Filed: Oct. 21, 1981

[51] Int. Cl.[3] ..... H01P 5/103

[52] U.S. Cl. ..... 333/26; 333/34

[58] Field of Search ..... 333/21 R, 26, 33, 34

[56] References Cited

U.S. PATENT DOCUMENTS

| | | | |
|---|---|---|---|
| 2,924,797 | 2/1960 | Robertson | 333/21 R X |
| 3,725,824 | 4/1973 | McDonald | 333/21 R |
| 4,144,506 | 3/1979 | McCammon et al. | 333/26 |
| 4,157,516 | 6/1979 | van de Grijp | 333/26 |
| 4,260,964 | 4/1981 | Saul | 333/26 |

*Primary Examiner*—Paul L. Gensler

*Attorney, Agent, or Firm*—Joseph S. Tripoli; Robert Ochis

[57] ABSTRACT

A coaxial transmission line to waveguide transition is formed of two waveguide portions disposed on opposing sides of, and enclosing a portion of, a flat plate structure. The enclosed portion of the flat plate structure includes a tapered slot extending through the flat plate structure leaving portions of the flat plate structure protruding into the waveguide as loading ridges which provide impedance matching (transformation) between the coaxial line and the unloaded waveguide. The flat plate structure has a hollow therein and an inner conductor passing therethrough forming a coaxial line. The inner conductor crosses the tapered slot within the waveguide enclosure.

8 Claims, 5 Drawing Figures

COAXIAL LINE TO WAVEGUIDE COUPLER

Figure 1:
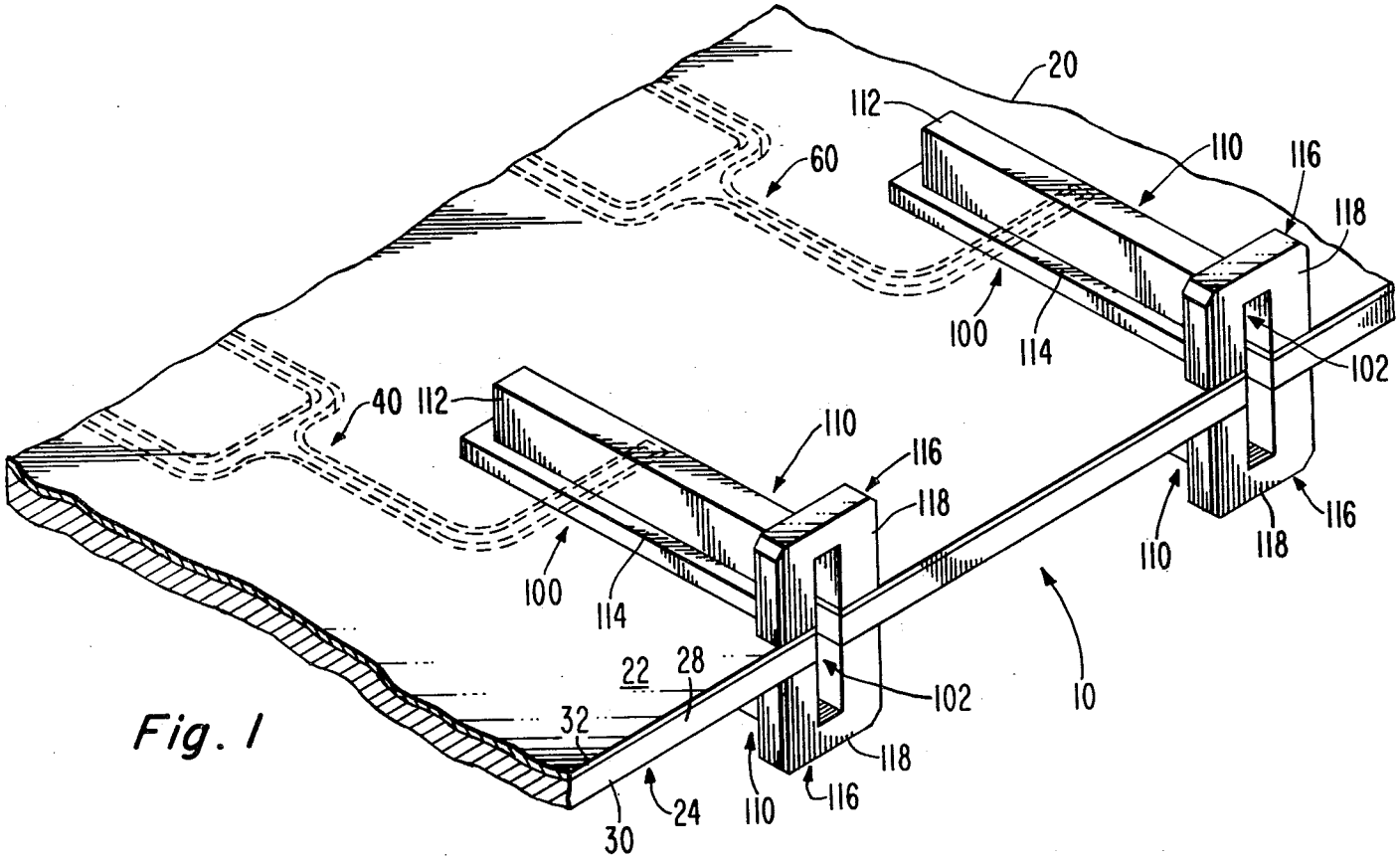

This invention relates to the field of radio frequency (RF) transmission lines and, more particularly, to coaxial transmission line to waveguide couplers.

In high frequency electronic systems, it is often desirable to implement part of the system in coaxial transmission lines and another part of the system in waveguide transmission systems. In order to transfer signals from one of these mediums to the other, a coaxial transmission line to waveguide coupler must be provided.

In the prior art, a number of techniques have been utilized in providing coaxial line to waveguide coupling. Some of these utilize in-line probes which extend parallel to the length of the waveguide. Others use E-plane probes which extend perpendicular to the broad wall of the waveguide. The waveguide portions of such couplers sometimes employ ridges to modify the impedance of the waveguide in the vicinity of the probe in order to minimize signal reflections.

Such couplers are normally provided with a connector for connecting the coupler to a coaxial transmission line and are themselves a piece of waveguide which is designed for connection to the remainder of the waveguide system.

Such couplers suffer from the problems of reflections associated with the coaxial line connectors and when used in the beam formers of phased array antennas are subject to the problems of connecting the coaxial connectors in close spaces, the risk of loosening of the coaxial connectors and the high cost of low VSWR coaxial connectors.

An improved coaxial transmission line to waveguide coupling structure is needed which is reliable, relatively inexpensive, has a low VSWR and minimizes the use of connectors.

In accordance with the preferred embodiment of the present invention a base plate having two major surfaces includes an elongated transmission line cavity disposed parallel to the major surfaces and enclosing an inner conductor of a coaxial transmission line for which the plate forms the outer conductor. A tapered slot extends entirely through the base plate and intersects and crosses the cavity and the inner conductor of the coaxial transmission line. First and second waveguide pieces are disposed in contact with the opposing major surfaces of the base plate to contain the tapered slot within the waveguide with the tapering of the slot forming a loading ridge within the waveguide. Preferably, the waveguide is short circuit terminated after crossing the inner conductor and the coaxial transmission line is open circuit terminated after crossing the waveguide.

Figure 2:
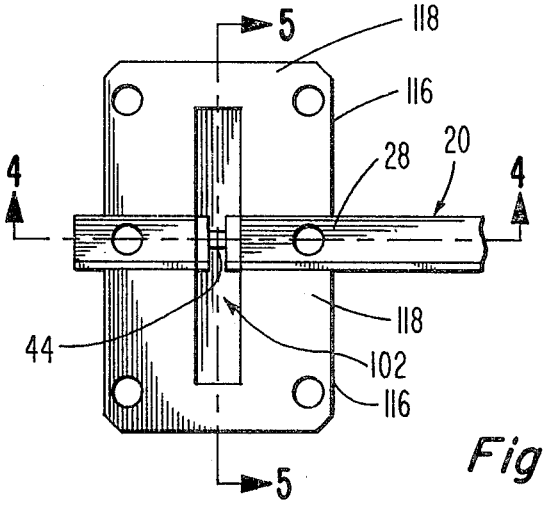
Figure 4:
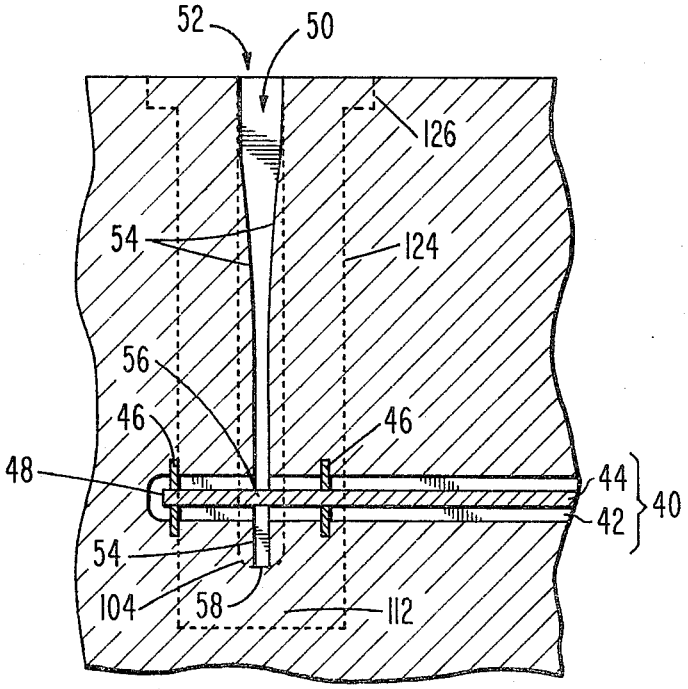
Figure 3:
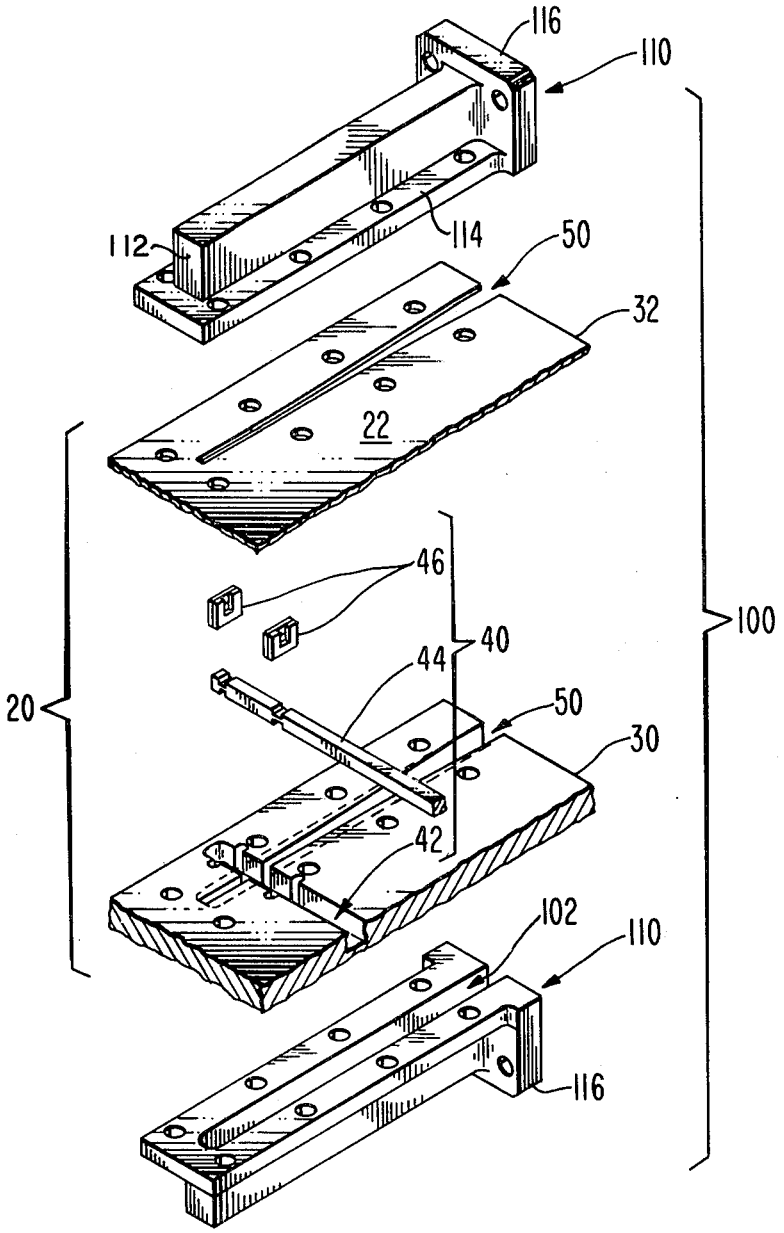
Figure 5:
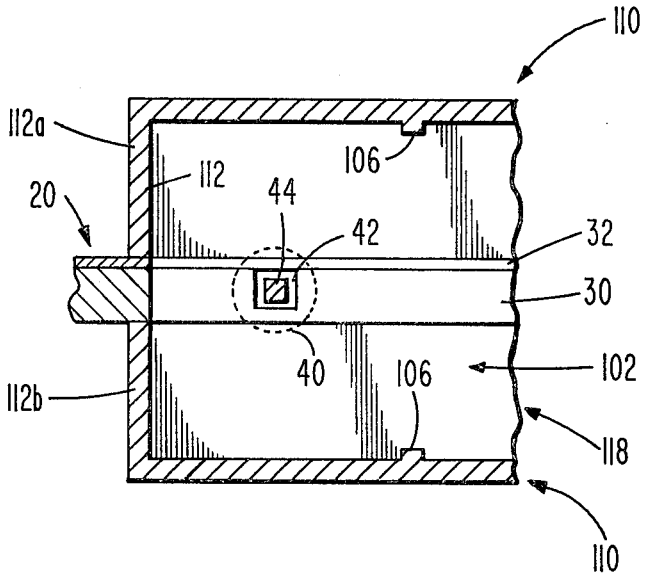

In the drawings:

FIG. 1 is a perspective view of two coaxial transmission line to waveguide couplers in accordance with the invention where both coaxial transmission lines are in a common flat plate structure, FIG. 2 is an end view of one of the coaxial transmission line to waveguide transitions of FIG. 1, FIG. 3 is an exploded view of one of the transistions of FIG. 1, FIG. 4 is a sectional view taken along the line 4—4 of FIG. 2, FIG. 5 is a sectional view taken along the line 5—5 of FIG. 2.

A coaxial transmission line to waveguide transition portion of a flat plate coaxial transmission line structure is illustrated generally at 10 in FIG. 1. The flat plate structure 20 has an upper surface 22, a lower surface 24 and an edge surface 28 and is composed of a main conductive metal plate 30 and a conductive metal cover plate 32. Within the flat plate structure 20 a number of coaxial transmission lines are provided. Two of these, 40 and 60, are illustrated but in phantom because the cover plate 32 hides then from direct view. This flat plate structure may be a beam former of a phased array antenna and may have as many as eight or more coaxial transmission line to waveguide transistions.

Two coaxial line to waveguide transitions 100 are illustrated. Each is comprised of a portion of the flat plate structure 20 sandwiched between two U-shaped waveguide half pieces 110. The waveguide pieces 110 are attached to plate structure 20 and each other by bolts through flanges 114. The waveguide pieces 110 form a longitudinally extending cavity 102. Each waveguide piece 110 has a terminating wall 112 at one end of cavity 102 and a flange 116 at its other end (118) suitable for attachment to a further waveguide portion of an RF signal transmission system. Flanges 116 are flush with the edge surface 28 of the flat plate structure.

The coaxial transmission lines 40 and 60, shown generally in FIG. 1, are configured in accordance with the signal transmission desired therein. For example, when they comprise portions of the beam formers in a phased array antenna a succession of power dividers/combiners are used for beam forming.

FIG. 2 is an end-on view of the transition 100 looking directly at the faces 118 of the waveguide flanges 116 and edge surface 28 of the flat plate structure 20.

One of the coaxial line to waveguide transitions 100 is illustrated in an exploded view in FIG. 3. The base plate 30 of the flat coaxial structure has a channel 42 therein which, when the cover plate 32 is attached, defines the inner surface of a coaxial transmission line outer conductor. An inner conductor 44 is centered within this channel and is held in that position by dielectric spacers 46 which may be made of teflon. A tapered slot 50 extends completely through the flat plate structure 20 (both base plate 30 and cover plate 32) and along that portion of the flat plate structure 20 which is between the two waveguide pieces 110. The slot 50 is narrowest near the terminating wall 112 and tapers to its broadest at the end 118 of the pieces 110.

The section view in FIG. 4 taken along line 4—4 of FIG. 2 illustrates the alignment between the waveguide pieces 110 and the flat plate structure 20 with greater clarity. The outlines of the waveguide cavity 102 and flanges are illustrated by dashed lines 104 and 124, 126 respectively. The cavity 102 is of constant width. The tapered slot 50 in the flat plate structure 20 forms vertical side walls 54 which are tapered from a wide spacing (full aperture of waveguide) at waveguide end 118 (open end 52 of slot 50) to a narrow spacing at point 56 where the centerlines of the waveguide and the coaxial line cross and the inner conductor 44 of the coaxial line crosses the slot. Slot 50 is of constant width from point 56 to the closed end 58 of the slot at wall 112. Coaxial transmission line 40 extends beyond its intersection 56 with slot 50 and terminates in an open circuit termination 48.

The waveguide is short circuit terminated by terminating wall 112 approximately a quarter wavelength from intersection 56 for some frequency within the frequency range for which the transistion is designed. Similarly, the open circuit termination 48 of the coaxial transmission line 40 is approximately one quarter wavelength from the center line of the waveguide cavity at a frequency within the frequency range for which the transition is designed.

FIG. 5 is a cross-section of FIG. 2 taken along the line 5—5 and includes the waveguide pieces 110, a tuning ridge 106 within each waveguide piece 110 and the flat plate structure 20 including the coaxial transmission line 40. The tuning ridges 106 aid in providing an extremely low VSWR over a wide frequency range. These ridges are positioned in the waveguide approximately one quarter wavelength from intersection 56 at a frequency within the frequency range for which the transition is designed. Terminating wall 112 is comprised of wall sections 112*a* and 112*b*.

The entire flat coaxial transmission line structure 20 and waveguide pieces 110 are preferably formed by numerically controlled milling of solid aliminum stock. Thus, the flat plate structure 20 is solid aluminum everywhere except for where the coaxial transmission lines are located. The use of numerically controlled milling assures the fabrication of a precisely shaped mechanically rugged structure. The ridges 106 are left by not milling the waveguide pieces as deep at that point as they are along the rest of the waveguide piece. Stubs such as cylindrical rods extending into the waveguide cavity may be sutstituted for the ridges 106 if desired. That procedure is not preferred because of the need to separately form and insert those stubs.

It will be understood that, if desired, rather than single continuous cover plate 32, individual cover plates could be used for each coaxial transmission line if a thicker base plate 30 were utilized and an appropriately sized depression were milled to accommodate the insertion of a more limited cover plate. This could be advantageous in systems where it may be necessary to obtain access to a particular transmission line for adjustment or repair.

As finally assembled, the waveguide portion of the coax-to-waveguide system constitutes a waveguide loaded by a double tapered ridge where the ridges are the portions of the flat plate structure 20 which project into the waveguide cavity 102. The use of the long taper illustrated facilitates exact impedance matching of the coaxial transmission line 40 to the waveguide at the intersection 56 between the coaxial transmission line and the waveguide while simultaneously providing a smooth transition to the impedance of a ridgeless waveguide of the same dimensions at the face 118 of the waveguide. The inner surfaces 54 of the slot 50 are preferably tapered in a manner to constitute a Tchebycheff transfomer section.

In an embodiment of this invention which has been built for use over a 3.1 to 3.7 GHz frequency band, the cavity 102 is 0.400 inch (1.02 cm) wide by 1.158 inches (2.94 cm) high by 5.854 inches (14.9 cm) long. The flat plate coaxial structure 20 has an overall thickness of 0.525 inch (1.33 cm). Thus when assembled, the structure constitutes a waveguide 0.400 inch (0.101 cm) wide by 2.841 inches (7.22 cm) high by 5.854 inches (14.9 cm) long, and having a loading ridge 0.525 inch (1.33 cm) thick. This loading ridge is of tapering protrusion into the waveguide from the waveguide walls and constitutes a Tchebycheff transformer. The slot separating the facing surfaces of the two loading ridges tapers from a width of 0.395 inch (1.0 cm) wide at end 52 (wide end at the flange) to b 0.0948 inch (0.24 cm) wide at intersection 56 and is of constant width from there to the closed end 58 of the slot. The cavity for the coaxial line is 0.400 inch (0.101 cm) square and the inner conductor is 0.161 inch (0.41 cm) square but reduces to 0.90 inch (0.22 cm) wide by 0.161 inch (0.41 cm) high between point 56 where it crosses slot 50 and the open circuit termination 48 of the coaxial line. Over a frequency range of 3.0 to 3.8 GHz the maximum VSWR of this structure was 1.05. This is excellent electrical performance and augments the excellent mechanical compatibility of the structures which eliminate all need for coxial connectors in the vicinity of the coax to waveguide transition.

An additional advantage of using the ridged waveguide structure for this transition is that minor variations between the waveguide pieces and the flat plate structure have a minimum effect on the overall performance of this transition, since the construction avoids any attempt to make the inner surfaces of the waveguide and the inner surface of the slot 50 in the flat plate structure co-planar for any extended length. In the event of such an attempt at co-planarity, slight variations would have adverse effects on the transition's electrical performance because of the resulting non-flat wall of the waveguide. In the present structure, such small variations create no problem because of the significant intentional spacing between the inner edge 54 of the slot 50 and the inner surface (104 in FIG. 4) of the waveguide piece 110.

In a flat plate structure such as that illustrated in FIG. 1 where there are a plurality of coaxial line to waveguide transitions, there is no necessity that the front faces 118 of the different transitions 106 be co-planar. Rather, they may be staggered in spacing, and even non-parallel from transition to transition, if desired, in accordance with the desired overall structure of the transmission system.

What is claimed is:

1. A coaxial transmission line to waveguide coupling structure for operation over a frequency range, said structure comprising:

a base plate having first and second major surfaces and an edge surface, said base plate having an elongated transmission line cavity therein;

an inner conductor disposed in said transmission line cavity and spaced from said base plate to form a coaxial transmission line with said base plate forming the outer conductor of said coaxial line, said coaxial transmission line terminated at one end;

said base plate having a tapered slot extending completely therethrough, said slot intersecting and extending beyond said coaxial transmission line; and first and second waveguide half-pieces, said first and second waveguide half-pieces contacting and extending from said first and second major surfaces, respectively, of said base plate over the region of said slot to form a waveguide having ridge loading provided by said base plate, said waveguide terminated at one end, said wavelength half-pieces extending the length of said slot whereby said waveguide and said coaxial line intersect and cross.

2. The coupling stucture recited in claim 1 wherein said waveguide termination is a short circuit approximately $\frac{1}{4}$ wavelength at a frequency within said range from where said inner conductor crosses said slot.

3. The coupling structure recited in claim 1 wherein said coaxial line termination is an open circuit approximately $\frac{1}{4}$ wavelength at a frequency within said range from said waveguide.

4. The coupling structure recited in claim 1 wherein:

the portion of said flat plate structure within said waveguide is symmetrically disposed with respect to walls of said waveguide to constitute a double ridge within said waveguide.

5. The coupling structure recited in claim 1 wherein:

said tapered slot is open at the wide end of said taper; and said open end of said slot is located at said edge surface.

6. The coupling structure recited in claim 1 wherein:

said transmission line cavity has a square cross-section and said inner conductor has a square cross-section.

7. The coupling structure recited in claim 1 wherein:

said waveguide has a rectangular cross-section.

8. The coupling structure recited in claim 7 wherein:

said waveguide further comprises first and second tuning stubs disposed in said waveguide and oriented parallel to the portion of said inner conductor which is in said slot, said stubs positioned in said waveguide approximately $\frac{1}{4}$ wavelength at a frequency within said range from said portion of said center conductor for reducing the VSWR of the coupling structure.

* * * * *